United States Patent [19]

Dahmen et al.

[11] 4,247,033

[45] Jan. 27, 1981

[54] METHOD OF AND DEVICE FOR PRODUCING MULTI-LAYER PIPES

[75] Inventors: Karl Dahmen, Hamm; Jürgen Engel; Heinz Gross, both of Dortmund; Martin Henning, Hamm; Werner Wennemann, Dortmund, all of Fed. Rep. of Germany

[73] Assignee: Hoesch Werke Aktiengesellschaft, Dortmund, Fed. Rep. of Germany

[21] Appl. No.: 949,156

[22] Filed: Oct. 6, 1978

[30] Foreign Application Priority Data

Oct. 8, 1977 [DE] Fed. Rep. of Germany ..... 2745389

[51] Int. Cl.[3] ..... B23K 31/06

[52] U.S. Cl. ..... 228/102; 72/49; 219/62; 228/9; 228/17.5; 228/145; 228/170

[58] Field of Search ..... 228/9, 17.5, 102, 145, 228/147, 170, 172; 72/49, 135, 367, 368; 219/62; 409/303

[56] References Cited

U.S. PATENT DOCUMENTS

| | | | |
|---|---|---|---|
| 1,929,415 | 10/1933 | Force | 228/17.7 |
| 2,318,732 | 5/1943 | Yoder | 409/303 |
| 3,093,103 | 6/1963 | Berkeley | 228/145 |
| 3,208,138 | 9/1965 | Eckhardt | 228/17.7 X |
| 3,267,570 | 8/1966 | Winkler | 228/145 X |
| 3,661,314 | 5/1972 | Tselikov et al. | 228/17.7 |
| 3,845,645 | 11/1974 | Gebaver | 228/17.7 X |

FOREIGN PATENT DOCUMENTS 1963805 10/1972 Fed. Rep. of Germany .

*Primary Examiner*—Kenneth J. Ramsey
*Attorney, Agent, or Firm*—Becker & Becker, Inc.

[57] ABSTRACT

A method of and device for producing multi-layer pipes by helically winding a plurality of bands loosely arranged one above the other, which are individually withdrawn from a supply, straightened out, trimmed, and in the form of a band loop are conveyed to the forming station at the respective angle of lead-in corresponding to the respective pipe diameter, whereupon the layers are together welded to form a pipe strand which is subsequently cut into individual pipes. All bands are supplied and advanced independently of the irregularities of the respective longitudinal band edge shape in steadily straight lead-in directions, and all band edges are machined together to a possible maximum width in coordination with each other whereupon the bands are driven together while the welding gap is controlled in conformity with their band edge shape merely by pivoting the pipe.

8 Claims, 12 Drawing Figures

FIG. 3
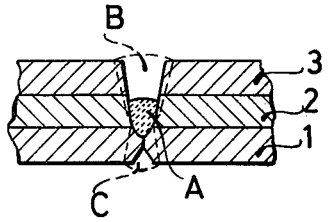
FIG. 8
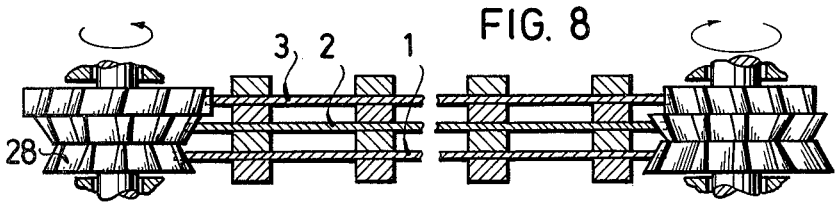
FIG. 7
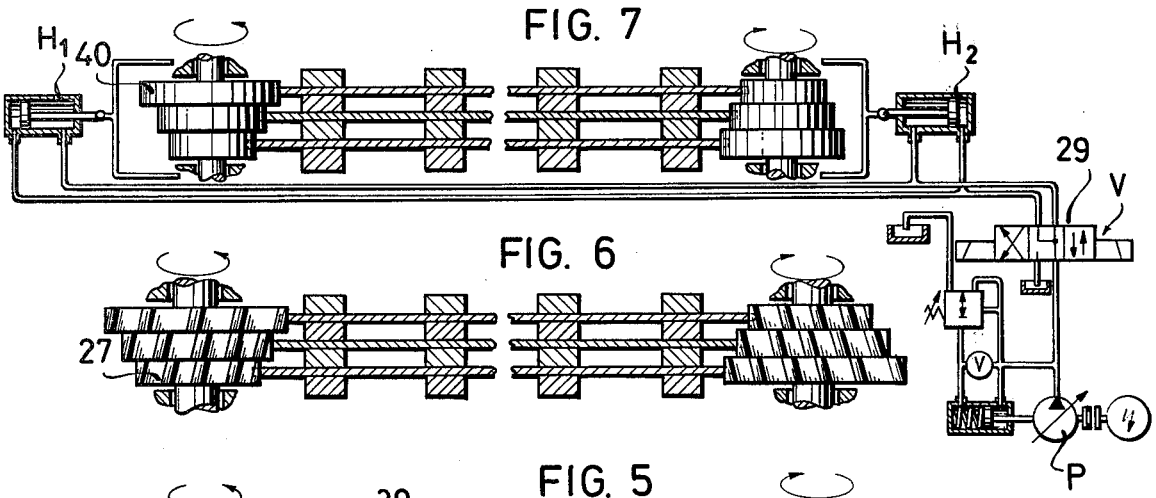
FIG. 6
FIG. 5
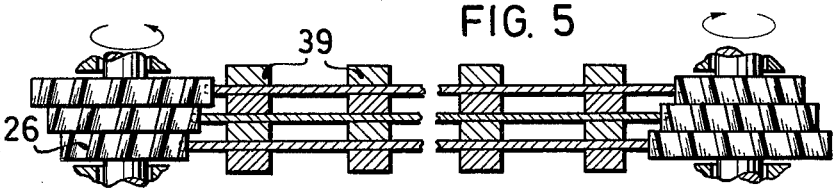

VIII
VII
VI
V
25
26
27
28
29
30
31
32
33
34
35
36
37
38
39
40
41
42
43
44
45
46
47
48

METHOD OF AND DEVICE FOR PRODUCING MULTI-LAYER PIPES

The present invention relates to a method of producing multiple layer pipes by helically winding a plurality of bands loosely arranged one above the other which are individually withdrawn from a supply and are straightened out, edge-trimmed and in the form of a band loop are conveyed to the forming station at the respective angle of lead-in corresponding to the respective pipe diameter, whereupon the layers are together welded to form a pipe strand which is subsequently cut into individual pipes.

The present invention furthermore comprises a device for practicing this method.

According to the method previously known, a plurality of bands is placed flush one upon the other and the bands are first continuously welded together within the region of their longitudinal edges. When forming the thus prepared multiple layer band into a helical seam pipe, these welding connections must be able to absorb the thrust of shear stresses resulting from the bending stresses. With economical band width of for instance 1,800 mm, the shear stresses require a high quality of such welding connection which can be met only at considerable expense with regard to the pretreatment of the band to be welded, the welding operation itself and the post-treatment of the welded areas. In addition thereto, the bands have to be placed flush one upon the other before the individual layers in strips can be welded together.

It is a well known fact that in practice all hot rolled bands have a more or less great "camber". When bands of different, especially alternately concave and convex edges are placed together, a "flush placing" is impossible.

Furthermore, German Pat. No. 1963805, corresponding to U.S. Pat. No. 3,661,314-Tselikov et al dated May 9, 1972, describes a device for producing two-layer helical seam pipes, according to which two individual bands arranged loosely one above the other are by separate band drivers conveyed to a forming station and formed into a helical seam pipe and welded. In this connection, the welding gap formed by each band with the already formed winding is in conformity with the "camber" of the band for each band controlled individually within the permissible narrow limits by a combined pivoting of the band and pipe. Automatically there are obtained different diameter changes independently of each other of the inner and outer layer of the pipe so that an air gap forms between the inner and outer layer. With the customary camber of hot rolled bands as they are employed for making helical seam pipes, especially when one of the respective band edges is convex while the other is concavely curved, the air gap may reach the magnitude of several millimeters. Such air gap causes considerable difficulty during the welding operation and affects the quality of the welding and thereby the quality of the pipe.

It is, therefore, an object of the present invention to provide a method and device for producing multi-layer helical seam pipes while individual bands loosely located one above the other are so formed that, considering the inherent camber and other irregularities of the longitudinal band edge shape, a proper forming of the bands will be assured with a minimum of machining and working expenses as well as at a minimum of loss in material.

This object and other objects and advantages of the invention will appear more clearly from the following specification in connection with the accompanying drawings, in which:

FIG. 3 illustrates a tacked butt joint of the helical seam of a three-layer pipe.

FIG. 5 represents a section taken along the line V—V of FIG. 4.

FIG. 6 is a section taken along the line VI—VI of FIG. 4.

FIG. 7 represents a section taken along the line VII—VII of FIG. 4 with pertaining hydraulic system.

FIG. 8 is a section taken along the line VIII—VIII of FIG. 4.

Figure 1:
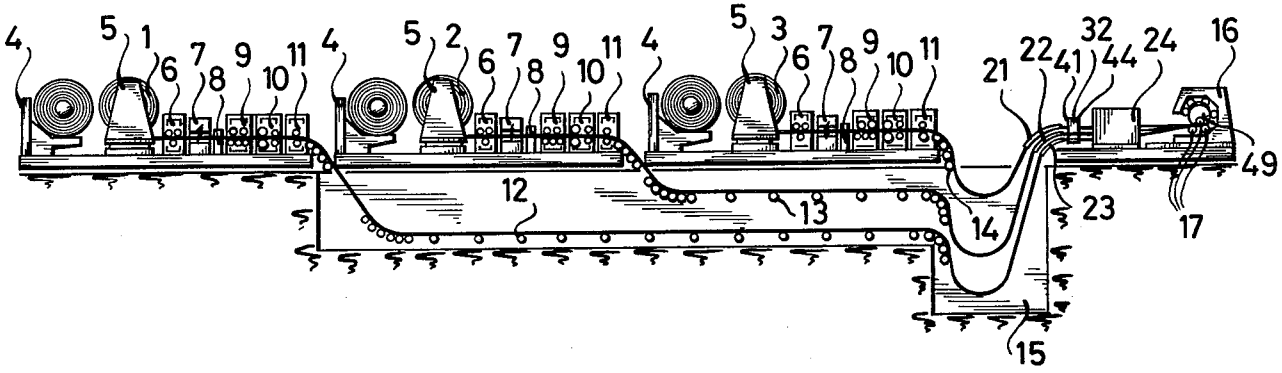
FIG. 1 is a side view of a device according to the invention.

The method according to the present invention is characterized primarily in that all bands are independently of the irregularities of the respective longitudinal band edge shape supplied in steadily straight lead-in directions, that all band edges together are machined in coordination with each other to their common possible maximum width or to the momentary maximum possible width, whereupon the bands are driven together while the welding gap is controlled in conformity with their coordinated band edge shape merely by pivoting the pipe.

This method brings about that the bands after being formed will lie one upon the other without a gap so that as a result thereof a common butt welding of all edges will be assured while permitting an advantageous employment of the tacking technique.

Furthermore, in view of the machining of the bands to the respective maximum width, the chip removing operation and the loss in material are reduced to a minimum.

The conditions for a proper forming of a plurality of multi-layer pipes with the assurance of an even pitch of the helical welding gaps and the prevention of relative movements between the individual bands during the welding operation are advantageously realized when, according to a further feature of the present invention, the bands are driven within the region of the bending line in the direction of lead-in. Such driving may also be employed when producing a one-layer pipe.

According to a further feature of the invention, the realization of the respective maximum width with a minimum of chip removing operations is made possible when the respective positions of the individual band edges are measured relative to each other, when the measured values are transformed into setting signals for the machining operation, and when each band side is machined independently of the other.

As a result of the present invention, an advantageous welding seam geometry will be obtained to such an extent that, if necessary, the band edges of one band only will have to be welded. It will even be possible to practice the tacking technique known per se, which means that the pipes are tacked in the forming station at high speed and in a continuous or discontinuous manner whereupon, separately and upon individual welding stands, the finishing welding operation is carried out.

The device according to the invention for practicing the method of the present invention is characterized primarily by the arrangement of a guiding system with two tensioning stations comprising guiding roller means and tensioning roller means and a machining station for the band edges with pertaining control on each side of the bands. The device furthermore comprises a combined bending and driving system and only one welding gap control.

According to a further development of the invention, the device is so designed that for a rectilinear guiding of the bands in the differently defined lead-in directions on each side of the bands there are provided a tensioning roller arranged in each band edge machining station and adapted to hold the three bands in common, while for each band there is provided a guiding roller arranged ahead of the band edge machining station, as well as a tracking system for controlling each guiding roller in conformity with the respective band edge contour.

By means of a particularly advantageous further development of the guiding system, the guiding rollers are adapted, following the band chamber, to be controlled in such a way that each point of each band will, in spite of different camber, retain its respective direction of lead-in. In view of the advantageous arrangement of the guiding rollers and tensioning rollers, a precise positioning of the band is assured in any position so that the tracking system will assure a proper adaptation to irregularities in the contour of the longitudinal extension of the band.

According to a further feature of the present invention, the station for machining the band edges substantially comprises a tool carriage with at least one gang cutter, a tensioning roller with the pertaining hydraulic system, and a set of profile cutters as well as a control system.

Instead of the milling tools, also other chip removing or cutting tools may be employed. Advantageously, the gang cutter, the tensioning rollers, and the gang profile cutters have a step profile corresponding to the lead-in directions and the spacing from the forming station.

According to still another feature of the invention, the upper roller and/or the lower rollers of the bending and driving device designed as a three-roller bending machine may comprise a shaft which is arranged parallel to the pipe axis and is provided with cardanically journalled race rings which are guided in lead-in direction by means of infinitely angle-adjustable guiding devices.

In this way it is assured that within the region of the bending line, at the start of forming the individual bands, the bands are compressed and bent together in a gap-free manner while each individual band is driven in the lead-in directions at speeds which are differently defined in their size and their direction. The race rings can be adjusted during operation in an infinitely variable manner.

Such device may also be used for manufacturing a one-layer pipe. The invention may be employed particularly advantageously when producing three-layer pipes with a diameter exceeding 1000 mm for high pressure line pipes, in which instance the pipe layers consist of similar bands.

The invention may, however, also be used to the same advantage when producing pipes which consist of different metal bands, especially metal bands of different mechanical grades.

Figure 9:
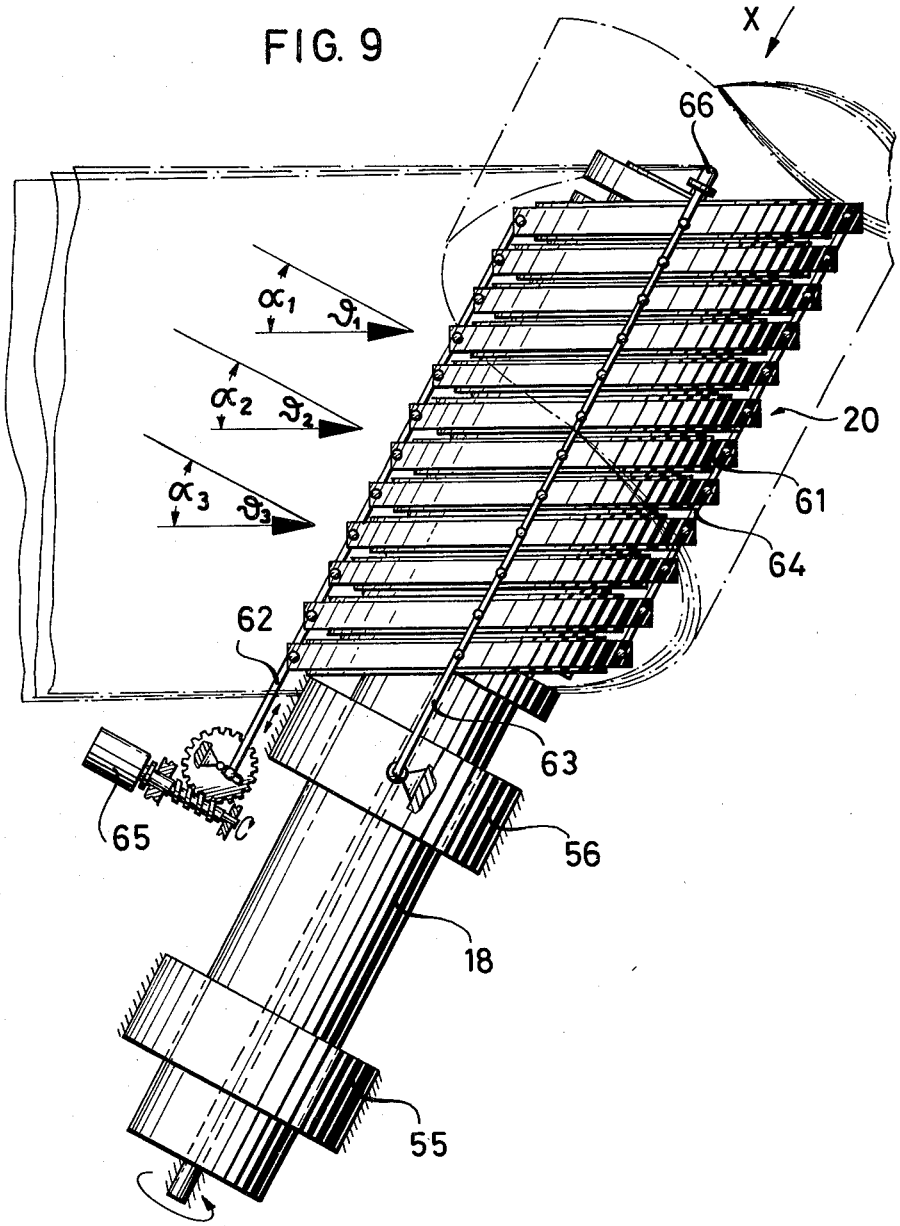
FIG. 9 is a top view of the upper roller of the combined bending and driving devices.
Figure 11:
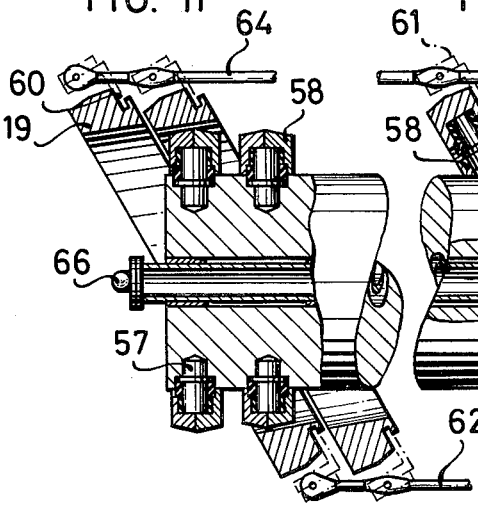
FIG. 11 is a fragmentary top view in section according to FIG. 9.
Figure 12:
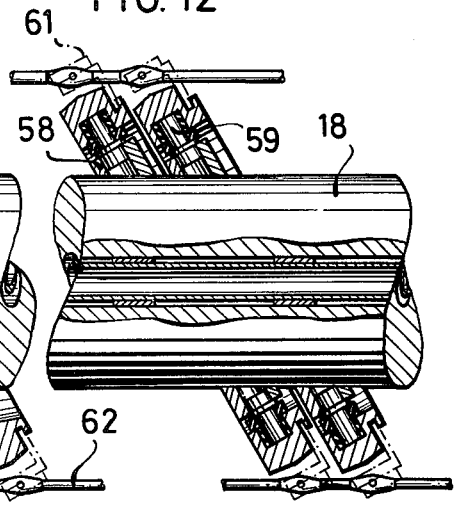
FIG. 12 is a fragmentary top view in section according to FIG. 9 but in a position after the shaft has been turned by 90° relative to the showing in FIGS. 9 and 11.
Figure 10:
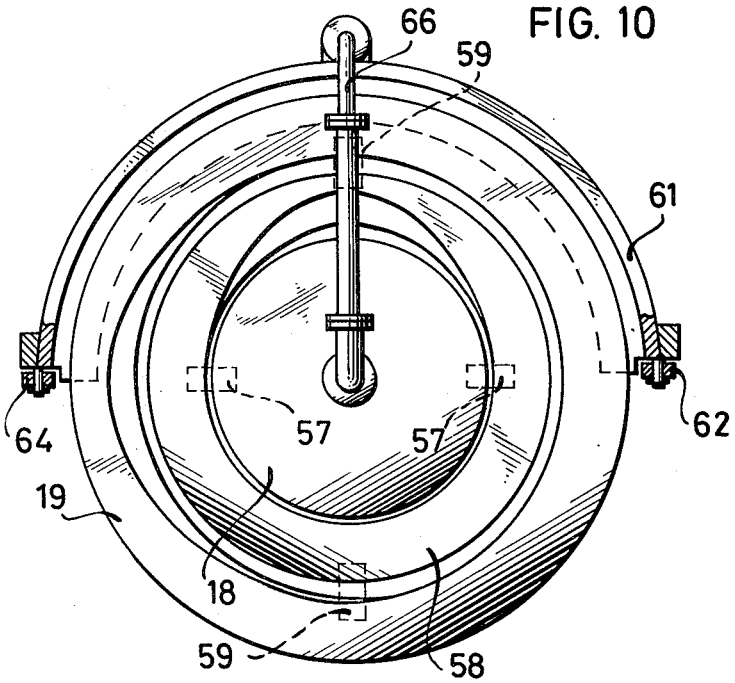
FIG. 10 is a view taken in the direction of the arrow X of FIG. 9 while with regard thereto the running rings are shown tilted into vertical position with regard to the shaft axis.

Referring now to the drawings in detail, as FIG. 1 illustrates, the bands 1, 2 and 3 which respectively form the outer, intermediate and inner layer of the pipe on three serially arranged band preparing devices with a coil receiving table 4, a coil reel 5, a dressing or straightening station 6, a transverse butt welding system 7, a band guiding device 8, a dressing or straightening device 9, edge trimming shears 10 with chip diminuting device and an auxiliary drive 11, are at the same time wound off, straightened out, edge-trimmed and moved over roller tables 12, 13, and 14 and conveyed into a loop pit 15. After having passed through the loop pit, the bands 1, 2 and 3 are driven together at speeds which are differently defined as to magnitude and their lead-in directions $V_1$, $V_2$, $V_3$ by a three-roller bending machine 17 which is arranged within the forming station 16 and which is provided with a driven upper roller and two non-driven angularly adjustable lower rollers which are separated into several small rollers. The upper roller (FIG. 9) comprises primarily a shaft 18 arranged in overhung manner and provided with cardanically journalled race rings 19 (FIG. 10), which are guided in a parallel manner through a guiding device 20 and which at a standstill as well as during the operation can be adjusted in an infinitely variable manner so that the direction of rotation of the race rings 19 is about parallel to the lead-in direction $V_3$ of the inner band 3. The non-illustrated individual small rollers of the two lower rollers of the three-roller bending machine 17 are adjusted in conformity with the lead-in direction $V_1$ of the outer band 1.

The bands which come out of the loop pit 15 are by guiding means 21, 22, 23 (FIG. 1) deflected and are at two band edge machining stations 24, arranged directly ahead of the forming station 18, machined on all band edges so that the band edges in the forming station form the seaming or trimming geometry (FIGS. 3 and 8) for a common butt welding of all bands and furthermore, independently of the respective camber and/or other deviations of the longitudinal edge shape of the bands, a respective maximum width will be realized. The guiding means 21, 22, 23 are pivotable in a horizontal plane about a vertical axis and are adjustable individually for each band.

Tool carriages 25 (FIG. 4) arranged on each side of the bands and provided with two serially arranged gang cutters 26 and 27 and with gang profile cutter 28 are in a direction perpendicular to the lead-in direction $V_2$ of the intermediate band so fed that the respective maximum possible width will be realized. The feeding is effected by a drive 30 in cooperation with a control 31 and feeler units 32 in conformity with the shape of the band edges.

The control 31 primarily consists of position indicators 33, 34, and 35, position evaluating means 36, control amplifier 37, and output reinforcing means 38.

Figure 4:
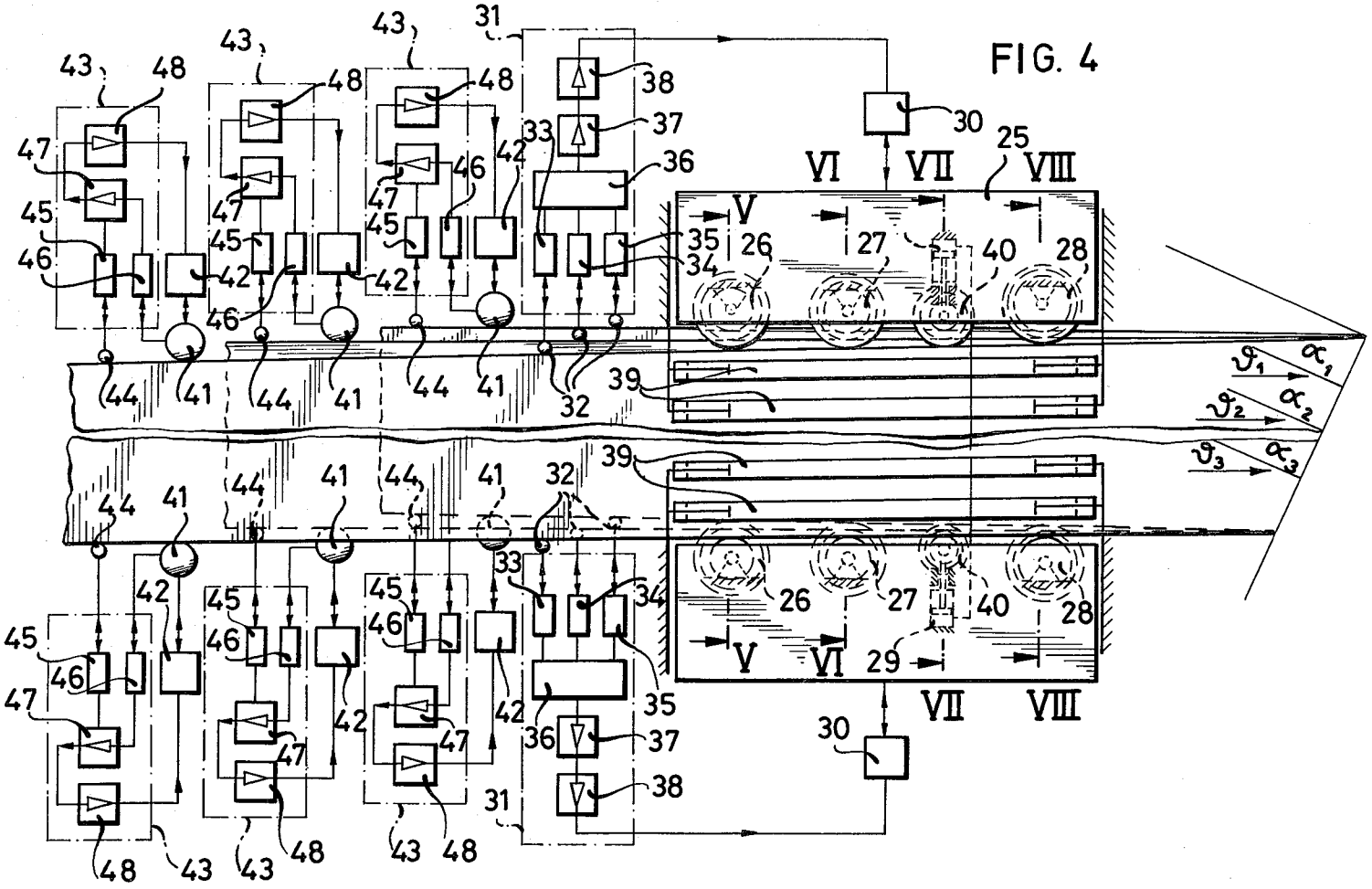
FIG. 4 illustrates a diagram of the maching of the band edges and also shows the band guiding system.

The respective diameter stepping of the gang cutters 26, 27 is determined by the difference in angle between the lead-in directions of the inner and intermediate, and the intermediate and outer bands respectively (FIGS. 4, 5 and 6).

The diameters of the gang cutters 26, 27 are so selected that the maximum cutting depth to be expected on both gang cutters is divided substantially equally. In this connection, the control 31 will assure that each cutting edge of the gang cutter 27 will be engaged but only a respective minimum total chip removal will occur. Profile and diameter stepping of the gang profile cutter 2 are predetermined by the selected seam or trimming geometry for the butt joint (FIGS. 3 and 8). By means of guiding strips 39, the bands in the band edge machining station 24 are guided in vertical direction. One tensioning roller 40 on each tool carriage 25, and one pair of guiding rollers 41 arranged ahead of the band edge machining station 24 and located opposite on each band serves for rectilinearly guiding the bands in conformity with the predetermined lead-in directions $V_1$, $V_2$, $V_3$ which are different from each other in view of the fact that the pitch of the helical lines is the same for all pipe layers, but the pipe layers have different diameters.

The tensioning rollers 40 (FIG. 4) are stepped in diameter in conformity with the angle difference between the lead-in directions of the inner and intermediate band and the intermediate and outer band. Furthermore, the tensioning rollers are by a customary hydraulic system 29 with adjustable constant force, which is the same for both sides, pressed against the edges of the three bands which have been milled in conformity with each other (FIG. 7). The hydraulic system 29 comprises an adjustable pump P, a 4/3 way valve V and two hydraulic cylinders $H_1$ and $H_2$.

It will thus be appreciated that the machined bands are not individually withdrawn and formed into a pipe. They are together and in spaced relationship to each other held by the tensioning rollers 40 (FIG. 7) and are together or super-imposed upon each other deformed in the three-roller bending machine 17 (FIG. 1).

The guiding rollers 41 are by drives 42 in combination with controls 43 and feeler units 44 adjusted in conformity with the longitudinal shape of the band edges.

The control 43 consists primarily of a rated value position indicator 45, and an actual position indicator 46, a control amplifier 47, and an output amplifier 48.

By means of this guiding system, the individual bands are always rectilinearly guided in conformity with the set of different lead-in directions. While the tensioning rollers 40 on both sides of the bands are pressed with equal force against the band edges already milled in conformity with each other, and therefore a displacement of the bands, which means a change in the lead-in direction, is excluded in view of the pressing-on force, a displacement of the bands by the guiding rollers 41 is prevented by the tracking control in view of the band edge shape deviating from the predetermined lead-in direction.

After the band edge milling has been effected, the bands are by means of the three-roller bending machine 17 (FIG. 1) within the region of the bending line driven and bent in common and subsequently the intermediate and outer band with their already formed winding are, for instance, continuously tack welded by means of the welding burner 49.

Principally it is merely necessary to tack the outer band 1 to the band edges, because the inner layers of the multilayer pipe of bands 2, 3 will be supported by the outer pipe layer 1. According to the specific example shown in FIG. 3, the band edges 1, 2 are interconnected by a tack welding A, since this type of tack welding has proved very satisfactory. The finish welding is effected on separate finish welding stations by an additional inner seam B and an outer seam C as will now be explained.

The finish welding of the entire butt joint could in this case be effected after separating or cutting off the corresponding pipe length on separate welding stands.

Figure 2:
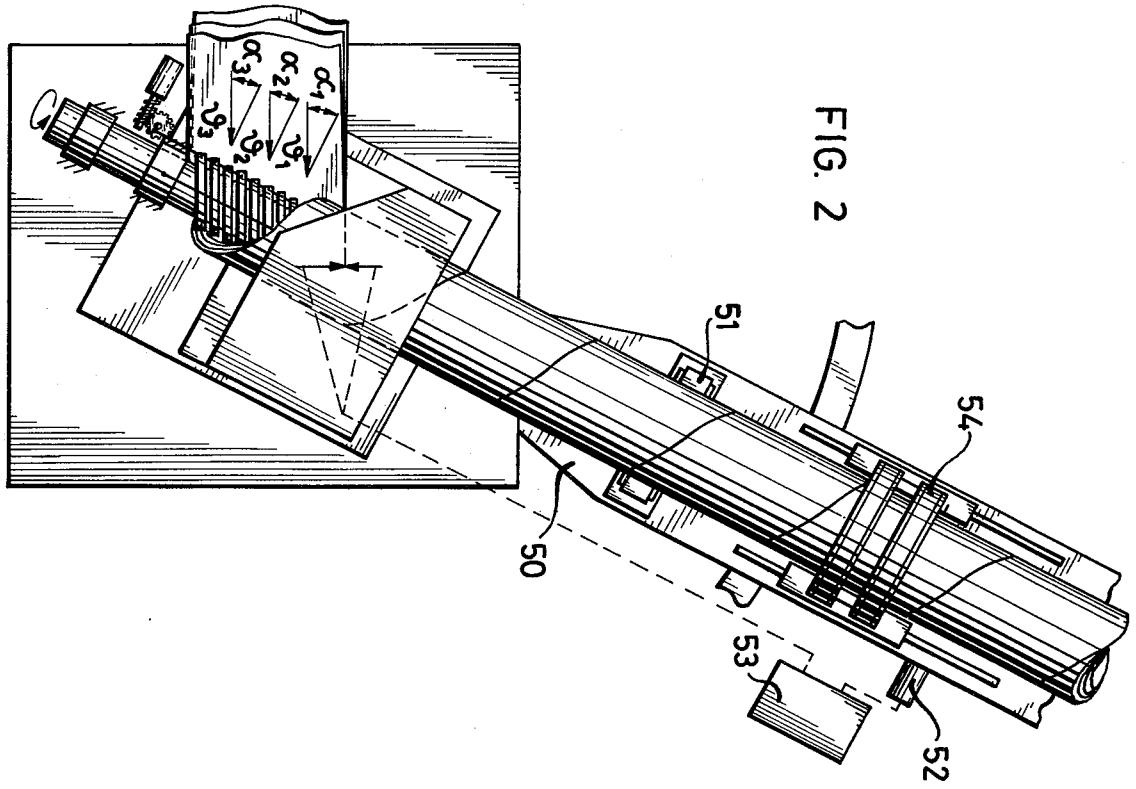
FIG. 2 is a top view of the forming station and the outlet frame.

For purposes of controlling the welding gap within the required narrow limits, it is merely necessary in a manner known per se to correspondingly pivot the pipe outlet frame 50 (FIG. 2) by means of a control member 51 by a drive 52 in cooperation with a welding gap control 53.

The endless produced tacked pipe can by means of a co-moving plasma cutting device 54 (FIG. 2) be cut into individual lengths and can on separate welding stations be finish welded from the inside B and outside C in conformity with the submerged arc welding method (FIG. 3). The head ends of the individual layers of a cut-off pipe section are not welded together.

When setting up this device, according to the present invention, the basic position of the angle $\alpha_2$ of the lead-in direction $V_2$ of the intermediate band 2 corresponding to the diameter of the intermediate pipe layer and the band width, is effected by straightening or aligning the pipe outlet frame 50, whereas the lead-in directions $V_1$ and $V_3$ with the angles $\alpha_1$ and $\alpha_3$ respectively are adjusted by slightly offsetting the guiding means 21, 23 and 41 of the inner and outer band relative to the guiding means 22, 41 of the intermediate band 2 (FIG. 1), while the rated angle deviations of the lead-in directions $V_1$, $V_2$, $V_3$ are fixedly predetermined relative to each other by step profiling of the tensioning rollers 40 (FIGS. 4 and 7).

In this connection, the angles $\alpha_1$, $\alpha_2$, $\alpha_3$ are to be understood as angles between the lead-in directions $V_1$, $V_2$, $V_3$ and the vertical upon the forming station axis.

For the function of the race ring adjustment on the upper roller of the three-roller bending device 17, it will be understood from FIGS. 9–12 that intermediate rings 58 are journalled by means of two diametrically arranged pivots 57 on the driven shaft 18 which is arranged in an overhung manner in the bearings 55, 56. On the outer circumference of the intermediate rings 58, pivotable about the common axis of the pivots 57 and offset by 90° with regard to pivots 57, there are diametrically arranged two pivots 59 about whose common axis race rings 19 are movable.

The guiding device 20 primarily comprises guiding grooves 16 in which race rings 19 are guided and supported. The guiding device 20 furthermore comprises bowl-shaped guiding segments 61 by means of which through the intervention of connecting rods 62, 63, 64 the race rings 19 can by means of an adjusting drive 65 be adjusted infinitely also during operation in the desired lead-in direction $V_3$. The connecting rod 63 is in this connection held on the bearing 56 and on a support 66 guided on the shaft 18. During the rotation of shaft 18, the race rings 19 will in view of the guiding device 20 remain in the adjusted lead-in direction $V_3$. By means of the cardanic mounting thrust intervention of pivots 57, 59, the intermediate rings 58 carry out a tumbling movement, two tumbling positions being shown in FIGS. 9 and 11 and 12 respectively.

It is, of course, to be understood that the present invention is, by no means, limited to the specific showing in the drawings, but also comprises any modifications within the scope of the appended claims.

What we claim is:

1. A method of producing multi-layer pipes from a plurality of bands, which includes in combination the steps of: advancing all bands in common and independently of the respective camber and other irregularities of the individual band edges in steadily straight lead-in directions corresponding to the respective pipe diameter, machining all band edges together in common for coordination atuned with respect to each other at the maximum possible width attainable at a particular time, helically winding said machined bands arranged one above the other, and welding said layers together to form a multi-layer pipe while controlling the welding gap in conformity with the coordinated band edges merely by pivoting the formed pipe to compensate welding gap changes.

2. A method in combination according to claim 1, which includes the step of driving said bands within the region of the bending line in said lead-in directions.

3. A method in combination according to claim 1, which includes the steps of: measuring the respective position of the individual band edges relative to each other, converting the ascertained measurements into adjusting signals for the machining of said band edges, and machining the band edges on each band side independently of the other band side.

4. A method in combination according to claim 1, in which after forming said bands into a pipe, the band edges of at least one band are welded together.

5. A device for producing single layer and multi-layer pipes by helically winding same into a pipe, which includes: a guiding system with two tensioning stations each comprising a guiding roller and a tensioning roller and a band edge machining station with a pertaining control device on each side of the path of the bands to be machined, said device also including a combined bending and driving system for receiving the machined bands and forming the same, and a welding gap control operatively connected to the pipe outlet frame for controlling the gap welding, the band edge machining station including a tool carriage with at least one gang cutter, a clamping roller with a hydraulic operating system, a gang profile cutter, and a control system.

6. A device according to claim 5, in which the gang cutter, the clamping rollers, and the gang profile cutter comprise a step profile corresponding to the course of said lead-in directions and the distance from said forming station.

7. A device for producing single layer and multi-layer pipes by helically winding same into a pipe, which includes: a guiding system with two tensioning stations each comprising a guiding roller and a tensioning roller and a band edge machining station with a pertaining control device on each side of the path of the bands to be machined, said device also including a combined bending and driving system for receiving the machined bands and forming the same, and a welding gap control operatively connected to the pipe outlet frame for controlling the gap welding, said bending and driving system including a three roller bending machine comprising upper and lower rollers at least one of which comprises a shaft aligned with the axis of the pipe being produced and provided with cardanically mounted race rings, said device also comprising guiding means for guiding said race rings in lead-in direction, said guiding means being angularly adjustable in an infinitely variable manner.

8. A device according to claim 7, in which for rectilinearly guiding the bands to be formed into a pipe in differently defined lead-in directions each tensioning roller is adapted to hold a plurality of bands at the same time, and in which for each band a guiding roller is provided ahead of said band edge machining station, said device also including a tracking system for controlling each guiding roller in conformity with the respective longitudinal band edge shape.

* * * * *